US005224896A

United States Patent [19]

Terzian

[11] Patent Number: 5,224,896

[45] Date of Patent: Jul. 6, 1993

[54] AMBULATORY DOLL

[75] Inventor: Rouben T. Terzian, Chicago, Ill.

[73] Assignee: Breslow, Morrison, Terzian & Associates, Inc., Chicago, Ill.

[21] Appl. No.: 825,153

[22] Filed: Jan. 24, 1992

[51] Int. Cl.[5] ..... A63H 13/02

[52] U.S. Cl. ..... 446/355; 446/354; 446/355; 446/268

[58] Field of Search ..... 446/268, 297, 298, 300, 446/303, 324, 330, 333, 334, 335, 352, 353, 354, 355, 356, 376, 377, 384, 390, 391, 489; 40/418, 420

[56] References Cited

U.S. PATENT DOCUMENTS

| | | | |
|---|---|---|---|
| 1,661,093 | 2/1928 | Rogers | 446/354 |
| 3,128,575 | 4/1964 | Stanetzski | 446/355 |
| 3,243,916 | 4/1966 | Ryan | 46/150 |
| 3,267,607 | 8/1966 | Ryan | 46/247 |
| 3,267,608 | 8/1966 | Ryan | 46/247 |
| 3,421,258 | 1/1969 | Gardel et al. | 46/247 |
| 3,425,154 | 2/1969 | Lindsay et al. | 46/150 |
| 3,445,960 | 5/1969 | Ryan | 446/355 |
| 3,475,857 | 11/1969 | Douglas et al. | 46/247 |
| 3,484,988 | 12/1969 | Robbins | 46/247 |
| 3,604,147 | 9/1971 | Ceccon | 46/150 |
| 3,609,909 | 10/1971 | Gardel et al. | 46/150 |
| 4,031,657 | 6/1977 | Crosman et al. | 446/333 |
| 4,467,555 | 8/1984 | Terzian et al. | 446/158 |
| 4,507,098 | 3/1985 | Terzian et al. | 446/288 |
| 4,878,874 | 11/1989 | Terzian | 446/355 |
| 5,088,954 | 2/1992 | Terzian et al. | 446/355 |
| 5,147,238 | 9/1992 | Kelley et al. | 446/268 X |

FOREIGN PATENT DOCUMENTS

| | | | |
|---|---|---|---|
| 26054 | 5/1906 | Fed. Rep. of Germany | 446/377 |
| 243729 | 11/1925 | United Kingdom | 446/355 |

*Primary Examiner*—Robert A. Hafer
*Assistant Examiner*—Sam Rimell
*Attorney, Agent, or Firm*—Dick and Harris

[57] ABSTRACT

A motorized, self supporting ambulatory doll having pivoting foot or ankle, knee and hip joints with internal hidden parallelogram linkages driving the legs in a realistic articulation as the doll walks or jogs. In addition, the doll's torso, head and arms pivot in cooperation and synchronization with the movement of the legs to enhance the realism of the movement of the doll. Two speed operation of the doll provides for selective walking or jogging operation and electronic speech is coordinated with the selected speed.

12 Claims, 4 Drawing Sheets

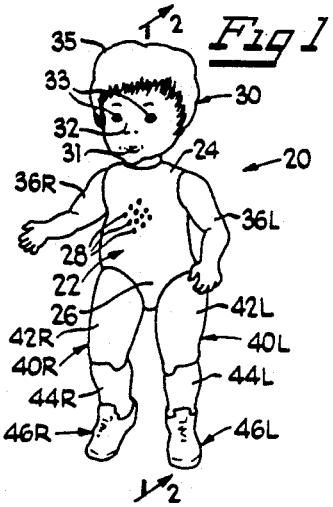
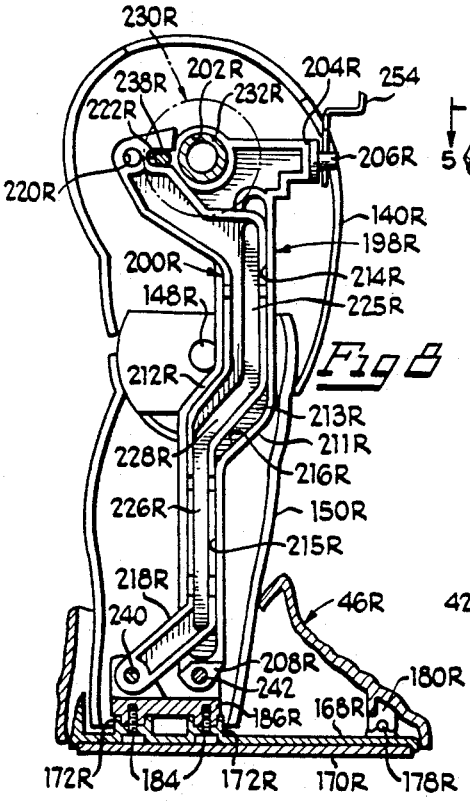
Fig 8
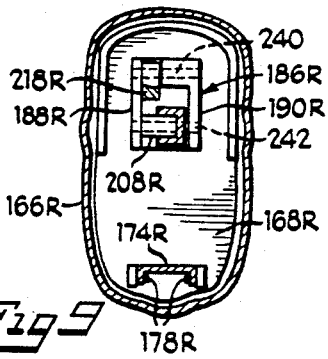
Fig 9
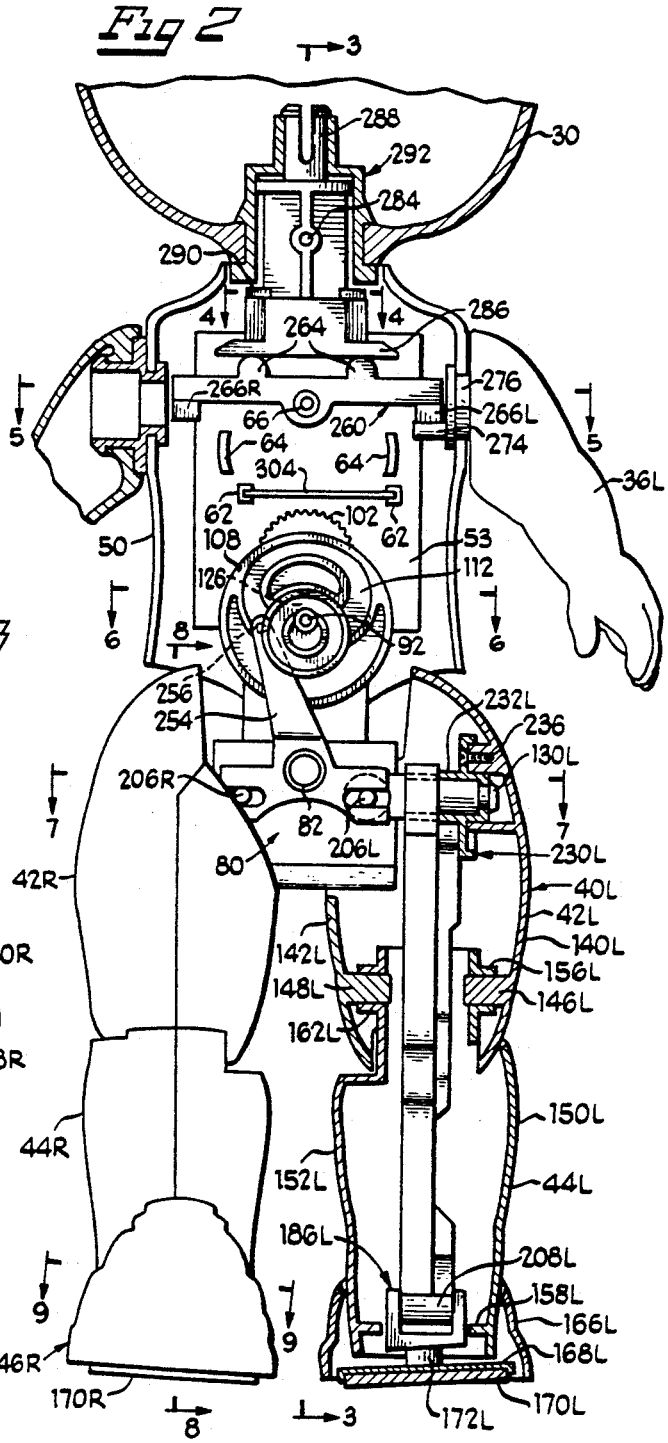

AMBULATORY DOLL

BACKGROUND OF THE INVENTION

1. Field of the Invention

This invention relates generally to ambulatory dolls and more particularly to mechanisms for articulating a motor driven doll for self supporting ambulatory movement in a realistic manner.

2. Background Art

Dolls with motor driven moveable legs for simulating walking are old in the art. Thus, for example, dolls or other characters with motor driven legs articulated for walking are shown in Paluck U.S. Pat. No. 1,684,287 issued Sep. 11, 1928; Ryan U.S. Pat. No. 3,243,916 issued Apr. 5, 1966; Ryan U.S. Pat. No. 3,267,607 issued Aug. 23, 1966; Ryan U.S. Pat. No. 3,267,608 issued Aug. 23, 1966; Gardel et al. U.S. Pat. No. 3,421,258 issued Jan. 14, 1969; Lindsay et al. U.S. Pat. No. 3,425,154 issued Feb. 4, 1969; Ryan U.S. Pat. No. 3,445,960 issued May 27, 1969; Robbins U.S. Pat. No. 3,484,988 issued Dec. 23, 1969; Ceccon U.S. Pat. No. 3,604,147 issued Sep. 14, 1971; Gardel et al. U.S. Pat. No. 3,609,909 issued Oct. 5, 1971; Terzian U.S. Pat. No. 4,878,874 issued Nov. 7, 1989 and copending Terzian et al. U.S. patent application Ser. No. 07/646,167 filed Jan. 25, 1991. In addition, there are prior art dolls with motor driven moveable legs articulated for other purposes, as for example, Douglas et al. U.S. Pat. No. 3,475,857 issued Nov. 4, 1969 for a doll supported in a sitting position on a moveable wheeled hobby horse transporter; Terzian et al. U.S. Pat. No. 4,467,555 issued Aug. 28, 1984 for a swimming doll and Terzian et al. U.S. Pat. No. 4,507,098 issued Mar. 26, 1985 for a roller skating doll.

The prior art dolls or characters disclosed in each of Paluck U.S. Pat. No. 1,684,287 and Terzian U.S. Pat. No. 4,878,874 require a wheeled supporting structure and the doll disclosed and claimed in copending Terzian et al. U.S. patent application Ser. No. 07/646,167 requires the user to support the doll by its hands and arms during the simulated walking. Considerable efforts have been expended to make a self-supporting ambulatory doll that moves in a realistic human manner and is stable during walking. Toward this purpose, the dolls disclosed in Ryan U.S. Pat. Nos. 3,267,608 and 3,445,960 use an inner leg assembly in combination with an outer leg shell to provide a parallelogram action to keep each foot of the doll parallel to the surface on which the doll is walking. In addition, to also help achieve stable, realistic walking, the prior art dolls of Ryan U.S. Pat. Nos. 3,267,608 and 3,445,960 as well as of Ceccon U.S. Pat. No. 3,604,147 provide a moveable member at the bottom of the foot. In the Ceccon patent, the lowermost surface contacting plate members, that is, the soles of the shoes, are spaced from the bottom of the feet by springs to enable the doll to advance step by step with a soft and elastic walking so that the doll looks like a walking baby. The movements of the human legs in any walking, jogging, or running action of course involve bending of the legs at the knee joints. While the doll supported upon a wheeled hobby horse in Douglas et al. U.S. Pat. No. 3,475,857, the doll supported by a wheeled frame in Paluck U.S. Pat. No. 1,684,287 and the doll supported by the child playing with it in copending Terzian et al. U.S. patent application Ser. No. 07/646,167 have hinged or pivoted knee joints, the self-supported walking dolls, do not have hinged knee joints. In addition to the movements of the legs themselves, coordinated movement of the torso, head and arms is also required in order to most realistically simulate human movement in a walking, jogging or running doll. There remains a need for a self-supporting ambulatory doll having motor driven legs which are themselves articulated for pivotal movement and which cooperate with other articulated portions of the doll to simulate walking or jogging in a realistic manner.

SUMMARY OF THE INVENTION

The present invention is concerned with providing a doll with motor driven articulated legs to cause the doll to walk or jog in a realistic manner. The foot or ankle, knee and hip joints are each pivoted and operated by linkages to produce a realistic articulation of each leg as the doll walks or jogs. In addition, the doll's torso, head and arms pivot in cooperation and synchronization with the movement of the legs to enhance the realism of the movement of the doll. Two speed operation of the doll provides for selective walking or jogging operation and electronic speech is coordinated with the selected speed.

BRIEF DESCRIPTION OF THE DRAWINGS

For a better understanding of the present invention, reference may be had to the accompanying drawings in which:

FIG. 1 is a perspective view of a doll embodying the present invention;

FIG. 2 is an enlarged scale, fragmentary view, partially in section taken generally along line 2—2 of FIG. 1;

FIG. 8 is a sectional view taken generally along line 8—8 of FIG. 2;

FIG. 9 is a sectional view taken generally along line 9—9 of FIG. 2;

DETAILED DESCRIPTION

Figure 3:
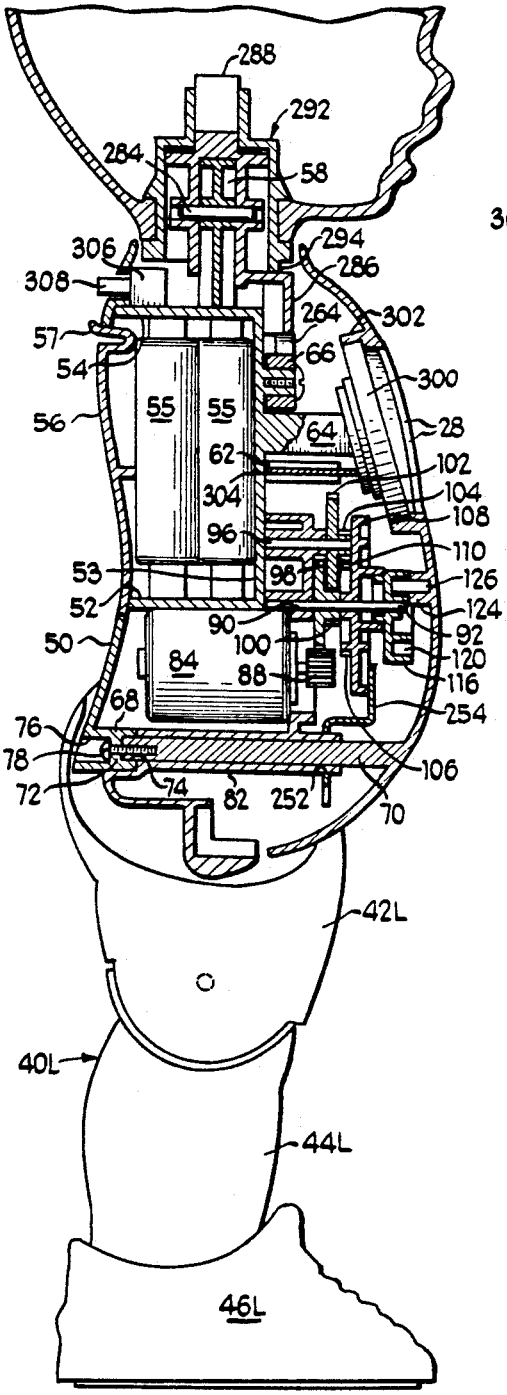
FIG. 3 is a sectional view taken generally along line 3—3 of FIG. 2.
Figure 4:
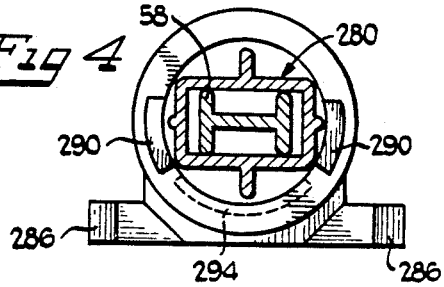
FIG. 4 is a sectional view taken generally along line 4—4 of FIG. 2.
Figure 5:
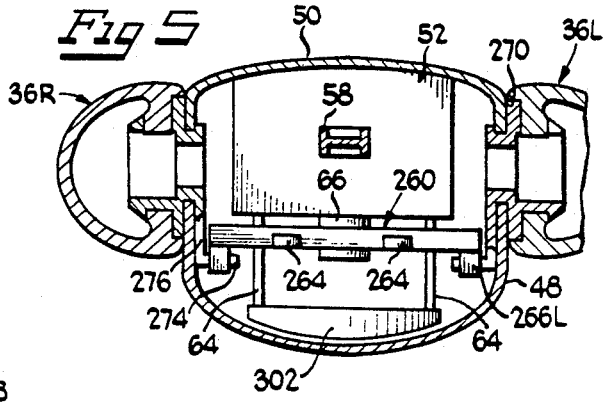
FIG. 5 is a sectional view taken generally along line 5—5 of FIG. 2.
Figure 6:
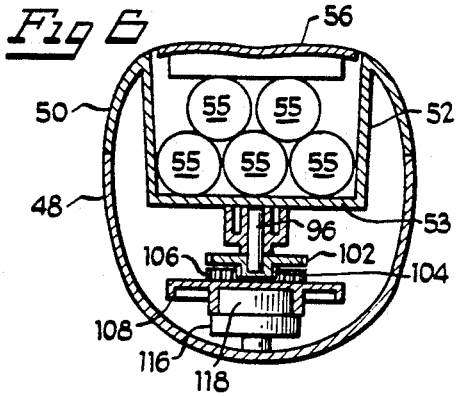
FIG. 6 is a sectional view taken generally along line 6—6 of FIG. 2.
Figure 7:
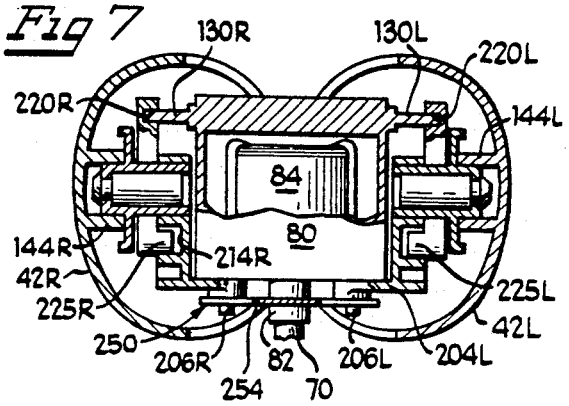
FIG. 7 is a sectional view taken generally along line 7—7 of FIG. 2.
Figure 10:
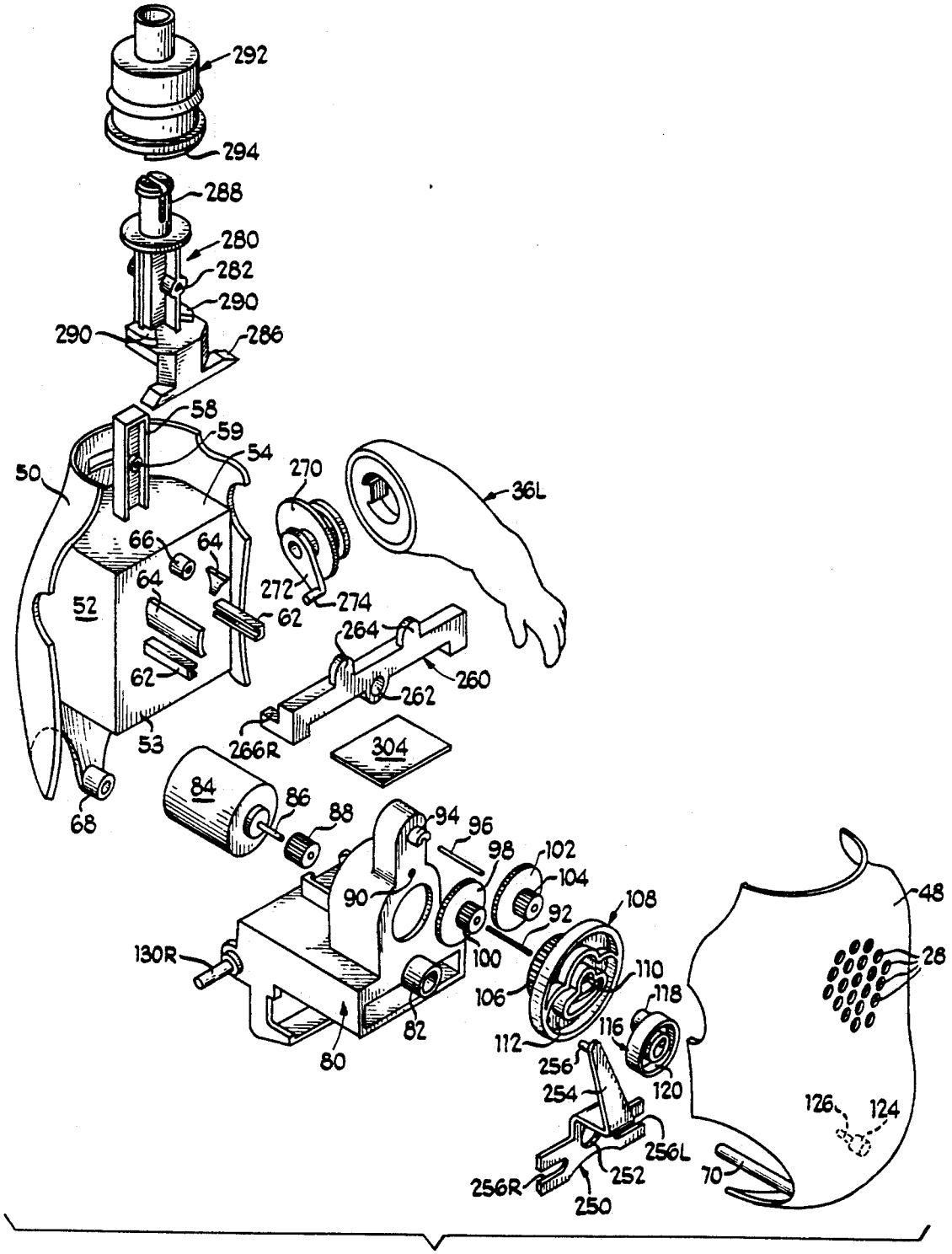
FIG. 10 is an enlarged scale, exploded perspective view of the torso and left arm of the doll shown in FIG. 1.

Referring now to the drawings in which like parts are designated by like reference numerals throughout the several views, FIG. 1 shows a doll 20 having a torso 22 which includes an upper neck and shoulder end 24 and a lower pelvic and hip end 26. Disposed in the chest area of torso 22 are a series of apertures 28. Carried atop neck and shoulder end 24 of torso 22 is a head 30. Conveniently, head 30 is provided with a mouth 31, nose 32, eyes 33 and hair 35. Doll 20 also includes a pair of right and left arms 36R and 36L, respectively, carried by torso 22 adjacent neck and shoulder end 24. A pair of right and left legs designated generally 40R and 40L, respectively, each include a respective upper thigh portion 42R and 42L, an intermediate calf portion 44R and 44L and a lower foot or shoe portion 46R and 46L.

Torso 22, which is substantially hollow, is formed of a front shell part 48 and a back shell part 50, as is best shown in FIG. 3. Apertures 28 are formed in and extend through front part 48. Included within torso 22 is a battery box 52 having an inner wall 53 and an upper wall 54. Battery box 52 may be formed as part of back shell 50 and houses five 1.5 volt AA batteries 55. Access to battery box 52 is provided by a removeable cover 56 in back shell part 50 of torso 22. Cover 56 includes a conventional resilient latch 57 to secure cover 56 to back part 50.

Extending upwardly from top wall 54 of battery box 52 is an elongated mounting post 58 having an aperture 59 extending through the post generally transverse to its elongated direction. Extending inwardly from inner wall 53 of battery box 52, toward from torso shell 48, are a pair of laterally spaced apart, opposed channel members 62. Disposed above channel members 62, and also laterally spaced apart, are a pair of forwardly projecting abuttment members 64. Generally laterally centrally disposed on inner wall 53, and also extending forwardly, is a mounting boss 66.

Each of front torso shell 48 and back torso shell 50 are conveniently formed with series of inwardly extending bosses for securing the two torso shells and for mounting various other parts. For ease of illustration, most of such bosses, the construction and use of which is known in the mechanical doll art, have been omitted. However, there is shown, adjacent the pelvic and hip area 26, an apertured boss 68 extending inwardly or forwardly from back shell 50 and an elongated boss 70 extending inwardly or rearwardly from front shell 48. Both of bosses 68 and 70 are generally centrally disposed with respect to the right and left side of the torso, and are substantially coaxially aligned. Apertured boss 68 has an internal wall 72 effectively dividing boss 68 into an inwardly facing bore 74 which receives the free end of boss 70 and outwardly directed bore 76 through which a securing bolt or screw 78 may be inserted through wall 72 and into boss 70.

Carried within torso 22 is a gear box 80 that includes apertured pivotal mounting sleeve 82. The inner diameter of the aperture of sleeve 8 is sufficiently large to rotationally receive boss 70 to mount gear box 80 within torso 22 for limited pivotal movement about the coincident axes of bosses 68 and 70. A DC motor 84 is carried by gear box 80 disposed generally below battery box 52. Motor 84 has an output shaft 86 to which output pinion 88 is secured for rotation with the output shaft.

Gear box 80 has an aperture 90 in its forward face for receiving a press fit shaft 92. Also included in gear box 80 is an apertured boss 94 for receiving a press fit shaft 96 substantially parallel to shaft 92. Mounted for rotation on shaft 92 is an integral, coaxial gear 98 and pinion 100. Mounted for rotation about the axis of shaft 96 is an integral, coaxial gear 102 and pinion 104. Also mounted for rotation about the axis of shaft 92 is an integral, coaxial gear 106 and face cam 108. As is best illustrated in FIG. 3, motor output pinion 88 is in driving engagement with gear 98. Pinion 100 is in turn in driving engagement with gear 102 and pinion 104 is then in driving engagement with gear 106. Accordingly, face cam 108 is rotated by motor 88 at a slower speed through the speed reducing gear train 88, 98, 100, 102, 104 and 106. Face cam 108 includes a generally centrally disposed, somewhat triangularly shaped, socket 110. Formed around socket 110 is an irregularly shaped cam groove 112. Both socket 110 and cam groove 112 are laterally symmetrical about a diameter through face cam 108.

Also mounted for rotation on shaft 92 is an eccentric 116 which has a somewhat triangularly shaped projection 118 that fits into and engages socket 110 in face cam 108. Projection 118 is on the rearward face of eccentric 116. On the forward face of eccentric 116 is an inner annular groove 120. Eccentric 116 is eccentrically mounted for rotation on shaft 92. Extending inwardly from approximately the navel region of front torso shell 48 is a blind bore boss 124. One end of a pin 126 is press fit into blind bore boss 124. The free end of pin 126 fits into and engages annular groove 120 of eccentric 118. Thus motor 84 through gear train 88, 98, 100, 102, 104 and 106 plus the engagement of projection 118 in socket 110 and pin 126 in annular groove 120, will cause limited side to side pivotal or rocking movement of torso 22 with respect to gear box 80 about the coincident axes of bosses 68 and 70.

Extending laterally outwardly from gear box 80 are opposed, respective right and left, stub shafts 130R and 130L, respectively.

Each of legs 40R and 40L are of similar construction. Accordingly, for ease of illustration, certain details of the same or mirror image parts are only shown and described with respect to one leg, it being understood that for each of the individual components expressly shown and/or discussed with respect to one of the legs, there is a corresponding component for the other leg.

Upper thigh 42R comprises an outer thigh shell 140R and an inner thigh shell 142R. Extending inwardly from outer thigh shell 140 is a socket 144R which includes three, integrally formed generally equally spaced apart, apertured mounting bosses 145R. Also inwardly extending from outer thigh shell 140R is a boss 146R. Extending inwardly from inner thigh shell 142R is a boss 148R that aligns with boss 146R when mating thigh shells 140R and 142R are placed together.

Intermediate calf portion 44R is similarly comprised of an outer shell 150R and an inner shell 152R. Adjacent the upper end of shell 150R is a recessed portion 154R from which extends an apertured boss 156R. Adjacent the lower end of outward calf shell 150R is an inwardly extending, generally semi-circular ledge 158R. Inner calf shell 152R has a recess 160R adjacent its upper end and an apertured boss 162R that extends in toward the center of the doll. In addition, like calf shell 150R, calf 152R also has a semi-circular ledge 164R extending into the inside of the calf portion.

As is perhaps best shown with respect to left leg 40L in FIG. 2, when upper thigh shells 140L and 142L are assembled about assembled calf shells 150L and 152L, inwardly extending bosses 146L and 148L fit into the apertures of respective bosses 156L and 162L to serve as trunnions for pivotal mounting of intermediate calf portion 44L with respect to upper thigh portion 42L.

Loosely fitting over the lower end of each of intermediate calf portions 44R and 44L is a respective shoe 46R and 46L. As with the legs themselves, each of the shoes comprises an assembly that is similar to the other shoe. Thus, right shoe 46R has an upper shoe 166R, a lower shoe 168R and a surface contacting, generally high coefficient of friction, pad 170R. Spaced apart along a generally central longitudinal axis of lower shoe 168 and projecting upwardly from the upper surface of lower shoe 168 are a pair of apertured bosses 172. Disposed adjacent the front atop the upper surface of lower shoe 168 is a bracket 174R having a pair of opposed laterally extending pins 178R. Preferably integrally formed with upper shoe 166R and projecting downwardly into the interior of the shoe adjacent its toe portion are a pair of spaced apart mounting brackets 180R. Each of brackets 180R has a notch adjacent its free end that fits over a respective one of the pins 178R. Accordingly, upper shoe 166R is connected to lower shoe 168R for pivotal movement of the upper shoe and lower shoe relative to other about a lateral axis adjacent the toe end. Pad 170R is secured to the underside of lower shoe 168R by a suitable, conventional adhesive or the like.

Figure 11:
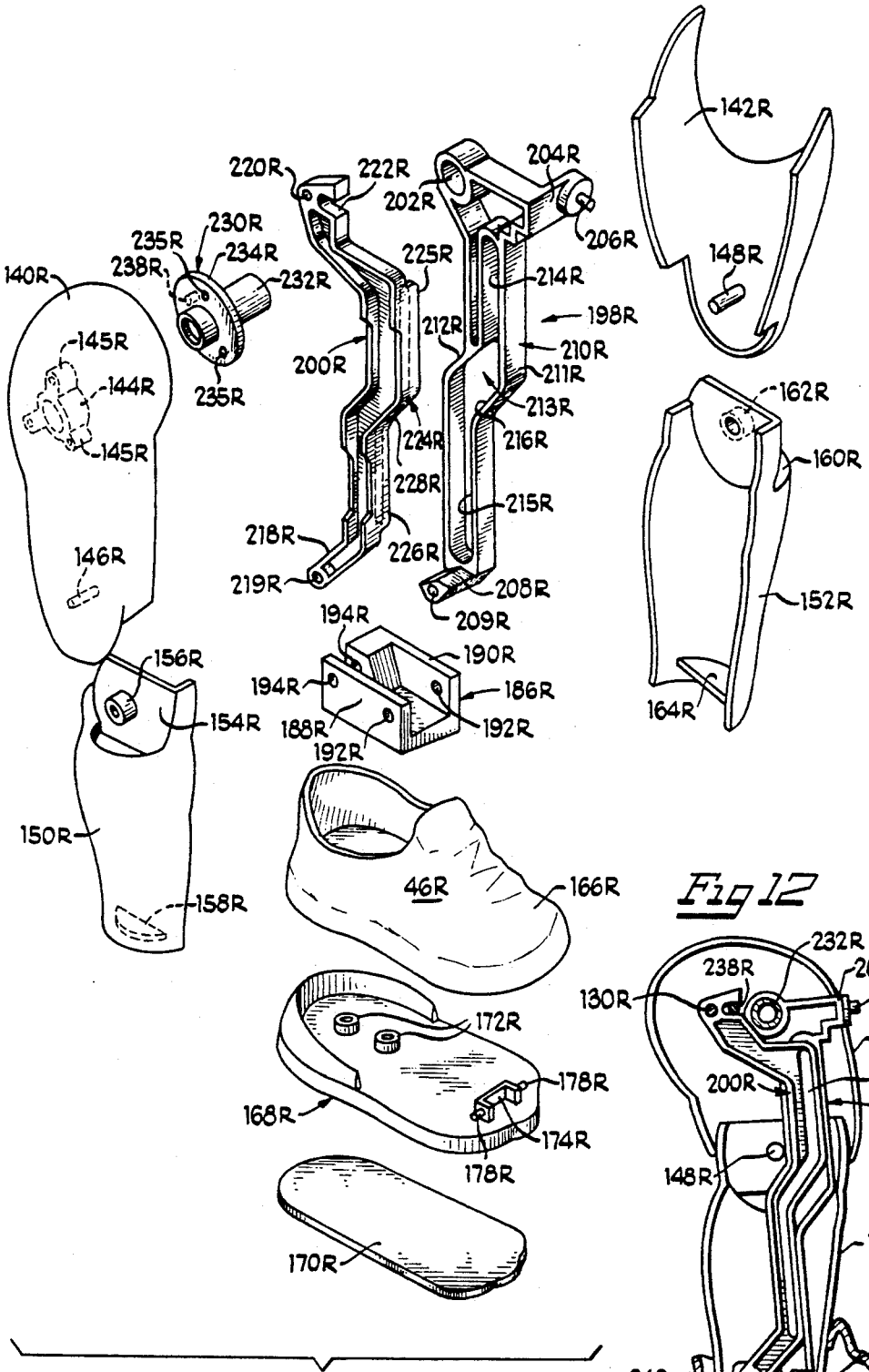
FIG. 11 is an enlarged scale, exploded perspective view of the right leg of the doll shown in FIG. 1.

Attached to lower shoe 168R by suitable, conventional threaded fasteners 184 extending through apertured bosses 172R is a shoe hinge block 186R. As is perhaps best illustrated in FIG. 11, shoe hinge block 186R includes a pair of spaced apart, upwardly extending walls 188R and 190R. A pair of aligned apertures 192R extend through walls 188R and 190R as do a pair of aligned apertures 194R that are spaced apart from apertures 192R.

Carried within leg 42R is a parallelogram linkage assembly comprising an inner elongated linkage member 198R and an outer elongated linkage member 200R. Adjacent the upper end of inner linkage member 198R is a transverse bore 202R. Spaced forwardly from transverse bore 202R is an inwardly directed extension 204R and projecting forwardly from adjacent the innermost end of extension 204R a pin 206R. At the lower end of inner linkage member 198R is a transversely extending apertured boss 208R extending transversely to the general direction of elongation of linkage member 198R. Between its upper and lower ends, inner leg linkage 198R has a generally "Z" shaped body 210R with walls 211R and 212R defining a generally "Z" shaped channel 213R with a pair of spaced apart, generally parallel channel portions 214R and 215R connected by an intersecting intermediate channel portion 216R.

Outer elongated linkage member 200R is also generally "Z" shaped and also has an extension 218R angling rearwardly adjacent its lower end. There is a transverse aperture 219R adjacent the free end of extension 218R. Adjacent the upper end of outer linkage member 200R, and more particularly adjacent the rearwardmost portion of the upper end is an transverse aperture 220R. Spaced forwardly of aperture 220R, but still adjacent the upper end of outer linkage member 200R is a slot 222R that is open at one end. The generally "Z" shaped body portion 224R of member 200R is both configured and dimensioned to fit, for limited up and down movement, within "Z" shaped channel 213R of inner linkage member 198R. Thus, body portion 224R has a pair of spaced apart, generally parallel portions 225R and 226R connected by an intersecting intermediate portion 228R. Each of portions 225R and 226R nest for sliding movement in a respective one of channel portions 214R and 215R of inner linkage member 198R. Intermediate portion 228R, which nests in intermediate channel portion 216R, is significantly narrower than channel portion 216R to allow for up and down movement of outer linkage member 200 with respect to inner linkage member 198R.

A right thigh plug 230R includes a central sleeve 232R and an annular flange 234R having three, generally equally spaced apart, apertures 235R extending through the flange. The portion of sleeve 232R projecting outwardly of flange 234R fits into and is received in socket 144R and each of mounting apertures 235R aligns with one of apertured mounting bosses 145R. Accordingly, right thigh plug 230R may be secured to outer right thigh shell 140R by suitable fasteners 236 which are shown in FIG. 2 with respect to the left leg.

Figure 12:
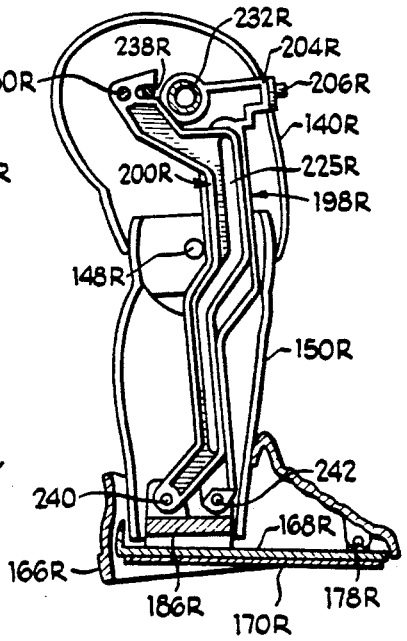
FIG. 12 is a sectional view of the right leg of the doll as shown in FIG. 2 that is similar to the sectional view of FIG. 8 but shows the leg as it is moving forward.

Sleeve 232R, or more particularly, the portion projecting inwardly from flange 234R fits into and is received in bore 202R of inner leg linkage 198R. Thus, inner leg linkage 198R is mounted for pivotal movement about the axis of sleeve 232R with respect to thigh 42R. Projecting inwardly from flange 234R is an integrally formed pin 238R, which is best shown in FIGS. 8 and 12. Pin 238R is disposed between two of the mounting apertures 235 and fits into and is received in slot 222R of outer linkage member 200R. Adjacent its upper end outer leg linkage 200R is mounted for pivotal movement with respect to gear box 80 on stub shaft 130R for rotation about stub shaft 130R which is rotationally received in aperture 220R.

The lower end of outer linkage member 200R fits between spaced apart walls 188R and 190R of shoe hinge block 186R and is mounted for pivotal movement with respect to the shoe hinge block. A pin 240 is press fit into aperture 219R and is received for relative pivotal movement in each of aligned apertures 194R. Similarly transverse boss 208R of inner right linkage member 198R fits between the spaced apart walls 188R and 190R of shoe hinge block 186R and is also mounted for pivotal movement with respect to the shoe hinge block. A pin 242 is press fit into aperture 209R and is received for relative pivotal movement in each of aligned apertures 192R. Thus, with outer linkage member 200R partially nestably received in channel 213R of inner leg linkage 198R, the respective upper and lower ends of each of the inner and outer leg linkages are attached for pivotal movement with respect to gear box 80 and shoe hinge block 186R for separate but related pivotal movement.

With the components of shoe 46R assembled and mounted through hinge block 186R, to inner and outer linkage members 198R and 200R, respectively, each of inwardly directed ledges 158R and 164R are proximate but spaced from the outer faces of sides 188R and 190R to limit any side to side movement of shoe 46R with respect to the intermediate calf portion, as is best illustrated in FIG. 2 with respect to the left calf 44L and shoe 46L. When assembled, each of the shoes, or more particularly the bottom surfaces of pads 170R and 170L are slightly angled to be higher at their outer edges than they are at their inner edges.

A cam follower link 250 has an aperture 252 that fits over boss 82 to mount link 250 on gear box 80 and permit relative pivotal movement of link 250 with respect to gear box 80. Angling upwardly from aperture 252 is a finger 254 that has, at its upper free end, an inwardly projecting pin 256 that is received in cam groove 112 of face cam 180. Thus, as face cam 108 is rotated, cam follower link 250 will be driven in a predetermined oscillating pattern about the axis of bosses 82, 70 and 68. Extending inwardly from each lateral edge of cam follower link 250 is a open ended slot 256R and 256L. Each of slots 256R and 256L receives a respective one of pins 206R and 206L. Thus, as cam follower link 250 is driven in its predetermined oscillating pattern, the engagement of, for example, pin 206R in its respective elongated open ended slot 256R will cause the respective inner linkage 198R to pivot about the axis of a thigh plug 230R. Left leg 40L will be similarly driven in an alternating, generally one hundred eighty degrees out of phase, movement relative to right leg 40R.

As a result of the parallelogram action of inner and outer linkage members 198R and 200R, respectively, as inner leg linkage 198R is moved upwardly, a shoe or foot 46R will advance forwardly substantially parallel to the surface on which doll 20 is supported. Because of the engagement between pin 238R and slot 222R of outer linkage member 200R, thigh plug 230R and hence assembled thigh shells 140R and 142R will be pivoted about the axis of the thigh plug. Forward and upward pivoting of leg 40R will result in pivotal movement of thigh 42R with respect to calf 44R in a manner similar to that of the relative pivotal movement of corresponding parts of the human leg.

Mounted for pivotal movement with respect to torso 22 is a swing support bar 260 which includes a generally centrally disposed bore 262 that fits over boss 66 on back wall 53 of gear box 52. Thus, swing support bar 260 is mounted for pivotal movement about the axis of boss 66. Disposed spaced laterally apart, approximately equidistant from bore 262, and projecting upwardly, are tabs 264. At its lateral ends, swing support bar 260 depends downwardly and then extends rearwardly to form levers 266R and 266L.

Each of arms 36R and 36L have an arm mounting plug 270. Extending outwardly from the center of plug 270 is a radial finger 272 at the free end of which is an inwardly extending pin 274. Arm mounting plug 270 is inserted in an opening at the shoulder end of each of arms 36R and 36L and so engages the arms as to normally maintain frictional driving engagement between the plug and the arm. However, the engagement between each arm and its respective plug also permits relative rotational movement between the arm and the plug should an excessive force be applied to the arm by the child to avoid change to the driving mechanism within torso 22.

Plug 270 has a annular groove 276 that permits rotational mounting of the plug, and of course the affixed arm, in an opening formed by the mating torso shells 48 and 50. The dimensions and relative coefficients of friction between the opening in the torso shells and the annular groove 276 of the plug permit relatively free pivotal movement of the arms with respect to the torso generally about an axis extending from one side of the torso to the other side of the torso. As is perhaps best illustrated in FIG. 2 with respect to left arm 36L, lever 266L is disposed immediately above and in engagement with pin 274 such that pivotal movement of swing support bar 260 causing lever 266L to move downwardly will pivot arm 36L upwardly and forwardly. When bar 260 swings to the other side and lever 266L moves upwardly, arm 36L will pivot back downwardly and rearwardly as a result of gravity.

Fitting through an opening formed by the assembled front and back torso shells 48 and 50, respectively, adjacent upper neck and shoulder end 24, is a neck swing member 280 that fits over and is mounted upon upwardly extending mounting post 58. Neck swing member 280 has a pair of aligned transverse apertures 28 extending through it that align with aperture 59 through mounting post 58. A pin 284 fits through aligned apertures 282 and 5 with the pin being press fit in mounting post aperture 59 and received in each of apertures 282 for relative pivotal movement. Therefore, neck swing member 280 pivots about the axis of pin 284 relative to mounting post 58. Neck swing member 280 includes a forward, downwardly depending bar 286, the lower edge of which is proximate, or even in contact with the upper edges of tabs 264 on swing support bar 260. At its upper end, neck swing member 280 has a bifurcated barbed stem 288. Generally disposed between apertures 282 and bar 286 are a pair of spaced apart rotational stops 290.

A neck plug 292 fits over neck swing member 280 and is retained against removal by bifurcated barbed stem 288 while being mounted for relative rotation about a generally vertical axis. On its bottom edge, neck plug 292 is provided with a depending arcuate projection 294 that is disposed between stops 290 The arcuate length of projection 294 is less than the distance between stops 290 permitting limited rotational movement of neck plug 292 relative to neck swing member 280. Head 30 which is conveniently made of vinyl or the like and is relatively flexible is force fit over neck plug 292 and retained o neck plug 292 in frictional engagement for rotation with the neck plug.

As torso 22 is pivoted or rocked from side to side with respect to gear box 80 as a result of the rotation of motor 84 transmitted through the previously described drive mechanism, head 30 will also be caused, by the rocking movement of torso 22, to swing or rock from side to side. At the same time that head 30 rocks from side to side about the axis of pin 284, and as a result of the side to side rocking, head 30 will, because of its mounting for limited rotational movement, also rotate from side to side about a generally vertical axis as limited by projection 294 engaging stops 290.

In addition to enhancing the overall articulation of the doll as it walks or jogs to more realistically simulate the motion of the human body, the side to side movement of the head assists in shifting the weight of the doll initially off of the forwardly moving leg and then back onto the moving leg as the bottom of the shoe contacts the surface on which the doll is walking. In addition, as head 30 rocks from side to side, depending bar 286 of neck swing member will contact tabs 264 of swing support bar 260 to pivot swing support bar 260 about the axis of boss 66. As previously described, the pivoting action of swing support bar 260 will drive the arms in a back and forth swinging movement in coordination with the movement of the legs to further enhance the realism of the articulation.

As a variation, rather than using the side to side rocking movement of head 30 to pivot swing support bar 260, a driving linkage (not shown) could be connected between swing support bar 260 and the previously described mechanism directly driving the pivoting of torso 22 and the articulated movement of legs 40R and 40L.

Disposed immediately behind apertures 28 in the chest region of front torso shell 48 is a speaker 300 which fits into a recess formed by a circular, inwardly projecting rim 302 that is integrally formed with front torso shell 48. Speaker 300 is maintained in place within rim 302 by abuttment of the free ends of members 64 projecting from rear wall 53 of battery box 52. Received in the opposed grooves of spaced apart channels 62 is a printed circuit board 304 of a type known in the talking doll art so that doll 20 may electronically speak various preselected phrases in a seemingly random manner.

A multi-position switch 306 is mounted adjacent the upper back of the torso with an actuator 308 extending out through an opening provided in back torso shell 50 for access by the user. Through suitable wiring (not shown) switch 306, motor 84 and batteries 55 are connected in a conventional manner known to those skilled in the art to provide power. Two of batteries 55 are used to drive the speech electronics. Of the remaining three batteries, two are connected to the motor whenever switch 306 is turned on, while the third of the remaining three batteries is connected to provide additional power to the motor when the switch is in a particular on position. With the motor powered by two of batteries 55, doll 20 walks and when the addition power of the third battery is added, the motor rotates at a faster speed and doll 20 jogs. When switch 306 is in the "walk" position, the phrases spoken by the doll will relate to walking and when switch 306 is in the additional power, "jog" position, at least some of the spoken phrases will relate to the doll moving at a faster pace.

While a particular embodiment of the present invention has been shown and described with one possible variation or modification, further variations and modifications will occur to those skilled in the art. It is intended in the appended claims to cover all such variations and modifications as fall within the true spirit and scope of the present invention.

What is claimed as new and desired to be secured by Letters Patents is:

1. An ambulatory doll comprising in combination:

a torso having an upper neck and shoulder end and a lower pelvic and hip end;

a head carried by the torso adjacent the upper neck and shoulder end;

a pair of arms carried by the torso adjacent the upper neck and shoulder end;

a pair of legs carried by the torso adjacent the lower pelvic and hip end;

each of the legs being carried for pivotal movement relative to the torso and for alternating pivotal, generally one hundred eighty degrees out of phase, movement relative to other of the pair of legs;

a motor carried by the torso;

the motor having a rotary output;

means for transmitting the rotary output of the motor into the alternating pivotal movement of each of the pair of legs;

each of the legs having an upper thigh portion, an intermediate calf portion and a lower shoe portion;

each of the upper thigh portions and intermediate calf portions being substantially hollow;

the upper thigh portion and the intermediate calf portion of each of the legs being connected for relative pivotal movement with respect to each other;

a shoe portion carried adjacent an end of the calf portion opposite the pivotal connection to the thigh portion;

a parallelogram linkage, including a first elongated member and a second elongated member, for each of the pair of legs;

each elongated member having an upper end and a lower end;

the upper end of each of the first elongated member being mounted for pivotal movement about a respective first axis;

the upper end of each of the second elongated members in the parallelogram linkage being mounted for pivotal movement about a respective second spaced apart axis;

the lower end of each of the first elongated members being connected to a respective shoe portion for pivotal movement about respective third axis;

the lower end of each of the second elongated members being connected to a respective shoe portion about a respective fourth axis;

means for transferring pivotal movement of one of the first or second elongated members to the respective pivotal movement of the leg about the first or second axis; and the parallelogram linkage for each leg being carried within the substantially hollow upper thigh portion and intermediate calf portion without preventing the relative pivotal movement of the calf portion with respect to the thigh portion.

2. The ambulatory doll of claim 1 in which at least a portion of one of the first or second elongated members of a parallelogram linkage is received for movement within the other of the first or second elongated members.

3. The ambulatory doll of claim 2 in which:

the one of the first or second elongated members of a parallelogram linkage into which the other of the elongated members is received includes a generally "Z" shaped channel;

the other of the elongated members includes a "Z" shaped portion that is received in the "Z" shaped channel;

the "Z" shaped channel includes a pair of spaced apart, generally parallel channels connected by an intersecting intermediate channel;

the "Z" shaped portion includes a pair of spaced apart generally parallel portions connected by an intersecting intermediate portion; and the intermediate portion of the channel is wider than the intermediate portion of the other elongated member that is received in the "Z" shaped channel.

4. The ambulatory doll of claim 1 in which each of the first and second elongated members is generally "Z" shaped.

5. The ambulatory doll of claim 4 in which the generally "Z" shaped member includes a pair or spaced apart, generally parallel portions connected by an intersecting intermediate portion.

6. The ambulatory doll of claim 1 including means mounting the head for side to side pivotal movement with respect to the torso.

7. The ambulatory doll of claim 6 including means mounting each of the arms for pivotal movement relative to the torso generally about an axis extending from one side of the torso to the other.

8. The ambulatory doll of claim 7 including means for driving the pivotal movement of each of the arms in coordination with the pivotal movement of the legs.

9. The ambulatory doll of claim 8 in which the means for driving the pivotal movement of the arm is drivingly connected to the movement of the head.

10. The ambulatory doll of claim 1 including means for operating the motor at different selected speeds.

11. The ambulatory doll of claim 1 including means for electronic speech.

12. The ambulatory doll of claim 11 including:

means for operating the motor at different selected speeds; and means for coordinating the means for electronic speech with the selected speed.

* * * * *